US006834753B2

(12) United States Patent
Krampl

(10) Patent No.: US 6,834,753 B2
(45) Date of Patent: Dec. 28, 2004

(54) ESCALATOR OR MOVING WALKWAY

(75) Inventor: David Krampl, Vienna (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/160,381

(22) Filed: May 31, 2002

(65) Prior Publication Data

US 2002/0179403 A1 Dec. 5, 2002

(30) Foreign Application Priority Data

Jun. 1, 2001 (EP) ..... 01810538

(51) Int. Cl.[7] ..... B65B 21/00; B65B 23/00
(52) U.S. Cl. ..... 198/326; 198/321
(58) Field of Search ..... 198/321, 326–330

(56) References Cited

U.S. PATENT DOCUMENTS 5,052,539 A * 10/1991 Fillingsness et al. ..... 198/328
6,129,198 A * 10/2000 Nusime ..... 198/326
6,374,981 B1 * 4/2002 Gschwendtner et al. .... 198/321
6,527,098 B2 * 3/2003 Krampl ..... 198/326
6,637,580 B1 * 10/2003 Sneed ..... 198/326

FOREIGN PATENT DOCUMENTS

EP 963941 A1 * 12/1999 ..... B66B/23/00
JP 03133895 A * 6/1991 ..... B66B/21/04
JP 04092040 A * 3/1992 ..... E04B/1/98
JP 05018136 A * 1/1993 ..... E04H/9/02
JP 11322243 A * 11/1999 ..... B66B/23/00

OTHER PUBLICATIONS de Silva, Vibration: Fundamentals and Practice, 2000.*

R.C. Hibbeler, "Engineering Mechanics Dynamics: 2nd Edition" 1978, pp. 547–553.*

Patent Abstracts of Japan, "Passenger Conveyer Device" Pub. No. 11314873, Nov. 16, 1999.

Patent Abstracts of Japan, "Supporting Device for Passenger Conveyor" Pub. No. 11310376, Nov. 9, 1999.

* cited by examiner

*Primary Examiner*—Eileen D. Lillis
*Assistant Examiner*—Mark A. Deuble
(74) *Attorney, Agent, or Firm*—Schweitzer Cornman Gross & Bondell LLP

(57) ABSTRACT

For reduction in externally excited oscillations there is provided at an escalator or a moving walkway an oscillation damper which is connected with the escalator or the moving walkway within a self-supporting region, preferably at the point of greatest oscillation displacement. The oscillation damper is preferably a speed-proportional plate damper comprising plates which move relative to one another in viscous oil.

4 Claims, 1 Drawing Sheet

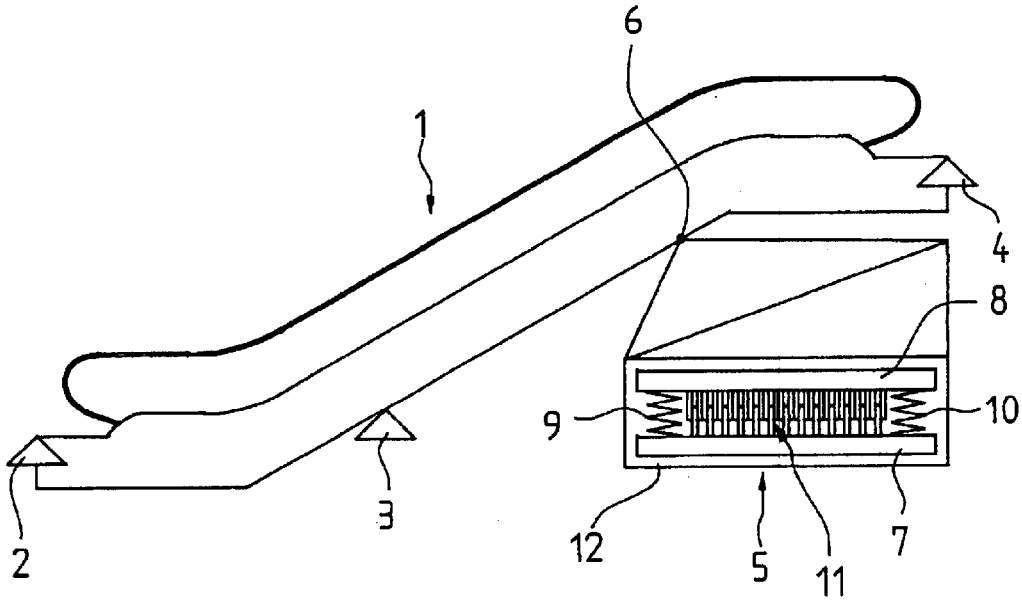
6
1
4
8
9
10
3
2
12
5
11
7

ESCALATOR OR MOVING WALKWAY

The present invention relates to an escalator or a moving walkway which is self-supporting over certain regions.

BACKGROUND OF THE INVENTION

In connection with statics calculations for escalators, consideration must be given to vertical framework oscillations which can be excited by chain engagement (resonant oscillations). When safety factors are applied, due to the sensitivity of the framework oscillation system relatively large forbidden regions result, particularly in the case of moving walkways with equal bay divisions. In the case of escalators with unequal bay divisions, these regions may be even larger due to the nature of safety factor computation and application. For these reasons only relatively small bay widths are often available.

BRIEF DESCRIPTIONS OF THE INVENTION

It is the object of the present invention to eliminate restrictions on available bay widths by providing an escalator with the capacity to control framework oscillations.

According to the invention this object is met by an escalator of the kind stated in the introduction in that for reduction of externally-excited oscillations there is provided an oscillation damper which is connected with the escalator or moving walkway within a self-supporting region, preferably at the point of the greatest displacement due to the oscillations.

According to the invention there is thus provided an oscillation damper which damps the resonant oscillations—should they occur—so that they no longer need to be taken into consideration in statics calculations. In this manner greater bay widths can be realised.

The oscillation damper is preferably a speed-proportional plate damper comprising plates which move relative to one another in viscous oil. Since the oscillations to be damped have only very small amplitude, a powerful damper is needed. Such a speed-proportional plate damper is suitable for this purpose.

BRIEF DESCRIPTION OF THE DRAWING

The present invention is explained in more detail by reference to the accompanying drawing which shows an escalator with an oscillation damper according to the invention.

DETAILED DESCRIPTION OF THE INVENTION

The escalator 1 illustrated in the FIGURE rests on the points 2, 3 and 4. A relatively short self-supporting region between the points 2 and 3 and a substantially longer self-supporting region between the points 3 and 4 result. An oscillation damper 5 is provided for damping the resonant oscillations. This is connected to the escalator 1 at the point 6, which lies in the longer self-supporting region where the oscillation displacement is of maximum elongation amplitude.

Preferably, the oscillation damper 5 may comprise two plates 7 and 8 connected together by way of springs 9 and 10. Between the springs 9 and 10 there is a region 11 where the two plates 7 and 8 interengage in a comb-like manner. The entire space 12 is filled with viscous oil.

Since the oscillation damper 5 must allow only the smallest possible deflections, the spring constants of the springs 9 and 10 must be high. The mass/spring ratio is established by reference to the oscillation equation and the frequency to be damped as known in the art. By virtue of the region 11 where the two plates 7 and 8 interengage in comb-like manner in the viscous oil, there is achieved powerful damping, which is also necessary because the oscillation amplitudes are very small.

It is possible by such an oscillation damper 5 to damp not only polygon-effect oscillations, but also other externally-excited oscillations.

Instead of a plate damper, other constructional forms of dampers, such as, for example, dampers loaded by gas pressure, elastomeric dampers or combination forms of such dampers, can be provided within the intended scope of the invention.

I claim:

1. An escalator or moving walkway comprising at least one self-supported suspended region located between a pair of spaced weight-bearing supports and an oscillation damper for damping vertical oscillations mounted to the escalator or the moving walkway within one of the self-supported regions the oscillation damper comprising a speed-proportional plate damper having plates which move relative to one another in viscous oil.

2. The escalator or moving walkway of claim 1, wherein the oscillation damper is mounted within the self-supported region at a point of maximum oscillation displacement.

3. The escalator or moving walkway according to claim 1 or claim 2, characterized in that the oscillation damper is a combined damper comprising a speed-proportional plate damper and a damper loaded by gas pressure.

4. The escalator or moving walkway according to claim 1 or claim 2, characterized in that the oscillation damper is a combined damper comprising a speed-proportional plate damper and an elastomeric damper.

* * * * *